US005357690A

United States Patent [19]

Ho

[11] Patent Number: 5,357,690

[45] Date of Patent: Oct. 25, 1994

[54] CENTRALLY FASTENED SHOE BUCKLE

[76] Inventor: Diana Ho, c/o Hung Hsing Patent Service Center P.O. Box 55-1670, Taipei (104), Taiwan

[21] Appl. No.: 113,349

[22] Filed: Aug. 30, 1993

[51] Int. Cl.[5] ..... A43B 11/00; A43C 11/00

[52] U.S. Cl. ..... 36/50.1; 36/50.5; 24/68 SK

[58] Field of Search ..... 36/50.1, 50.5; 24/68 SK, 513, 524, 568; 242/100.1

[56] References Cited

U.S. PATENT DOCUMENTS

| | | | |
|---|---|---|---|
| 3,738,027 | 6/1973 | Schoch | 36/50.5 |
| 4,395,801 | 8/1983 | Gabrielli | 36/50.1 |
| 4,631,839 | 12/1986 | Bonetti et al. | 36/50.5 |
| 4,727,627 | 3/1988 | Baggio et al. | 36/50.5 |

*Primary Examiner*—Paul T. Sewell
*Assistant Examiner*—Marie Denise Patterson

[57] ABSTRACT

A shoe buckle, especially for use on a roller skate boot, includes: a buckle body suspended and positioned on a central tongue of a shoe; two straps respectively secured to two upper side portions of a shoe upper and protruding inwardly to the buckle body of the shoe; a reel pivotally secured in the buckle body engageable with the two straps for fastening the two straps; a fastening device provided on a front or first end portion for driving the reel for fastening the straps for wearing the shoe on a wearer's foot; and a releasing device provided on a rear or second end portion for releasing the two straps for removing the shoe, thereby enabling a stable and convenient fastening of a shoe.

5 Claims, 4 Drawing Sheets

CENTRALLY FASTENED SHOE BUCKLE

BACKGROUND OF THE INVENTION

A conventional boot or shoe provided for use in a roller skate includes laces tied on two side upper portions of a shoe upper for fastening the boot or shoe to a wearer's foot, causing a very inconvenient operation when wearing the boot to the wearer or when removing it.

Even though a buckle may be provided on a side portion of the shoe upper for clasping a strap or belt passing over a tongue of the boot or shoe for fastening the boot on the wearer's foot, the side-positioned buckle may be attacked or hit by an external force such as being striken in a hockey game or when falling down to collide a ground floor, easily damaging the buckle as positioned at a side portion of the shoe tongue.

SUMMARY OF THE INVENTION

The object of the present invention is to provide a shoe buckle especially for a roller skate boot including: a buckle body suspended and positioned on a central tongue of a shoe; two straps respectively secured to two upper side portions of a shoe upper and operatively centralized to the buckle body of the shoe; a reel pivotally secured in the buckle body engageable with the two straps for fastening the two straps; a fastening means provided on a front or first end portion for driving the reel for fastening the straps for wearing the shoe on a wearer's foot; and a releasing means provided on a rear or second end portion for releasing the two straps for removing the shoe, thereby enabling a stable and convenient fastening of a shoe.

DETAILED DESCRIPTION

Figure 4:
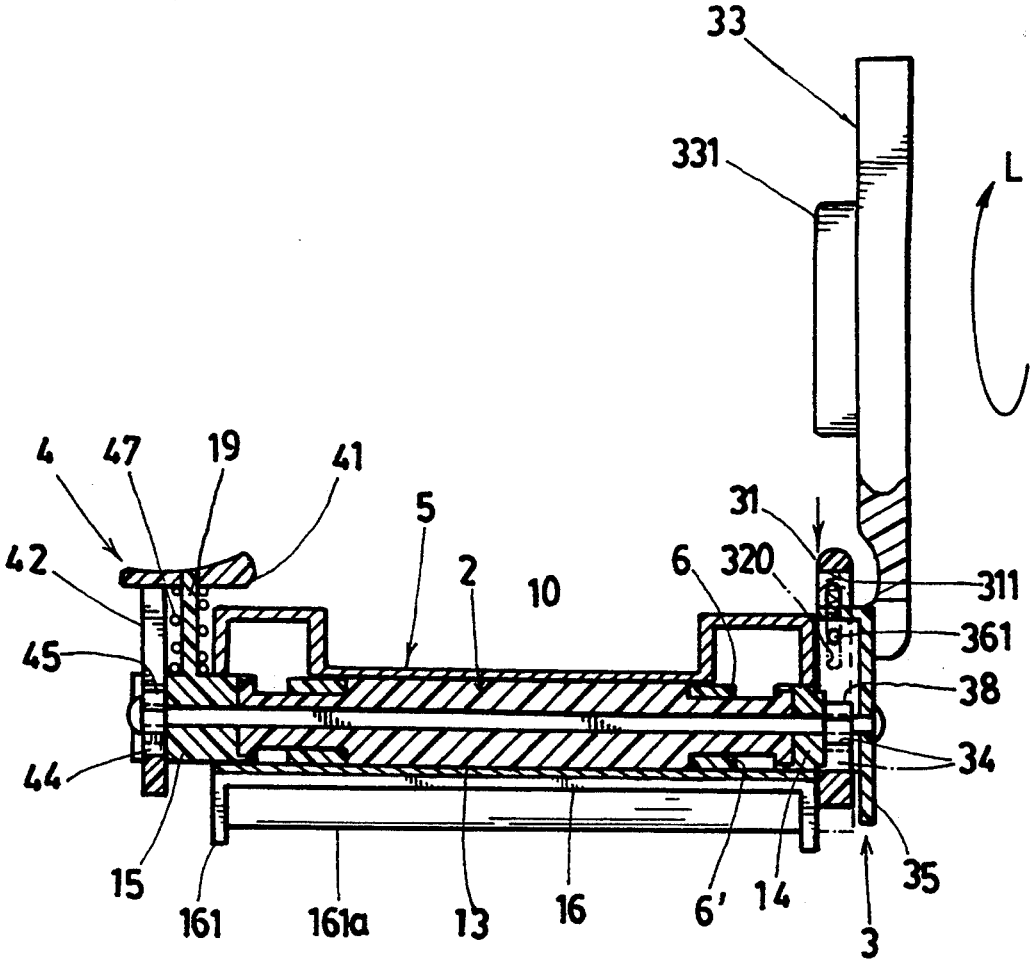
FIG. 4 is a sectional drawing of the present invention for a returning movement of the fastening means ready for a next fastening operation.
Figure 5:
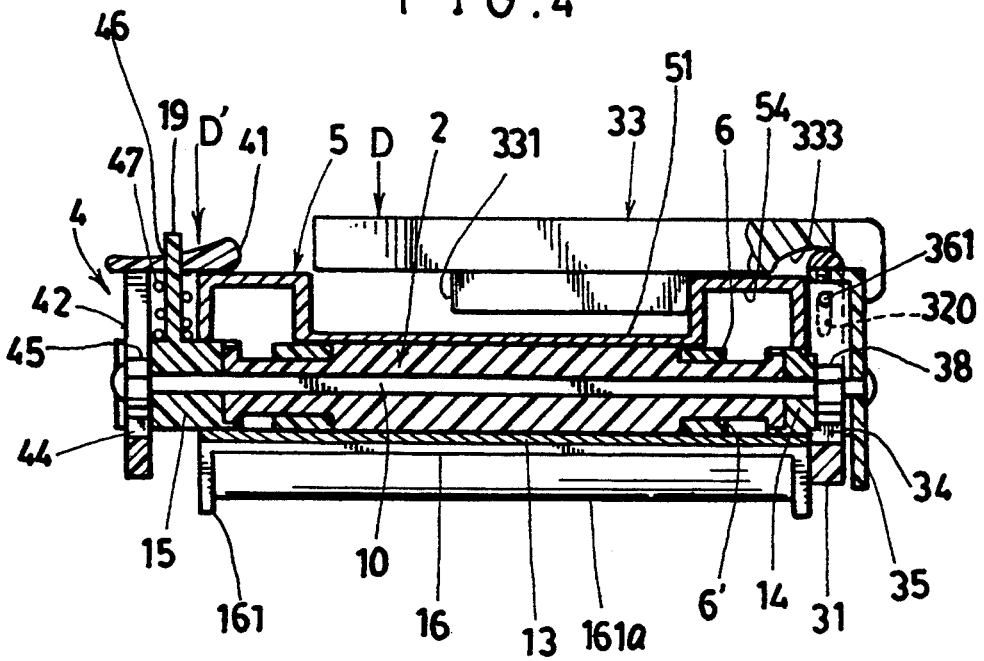
FIG. 5 is a sectional drawing of the present invention when covered by an upper cover.
Figure 6:
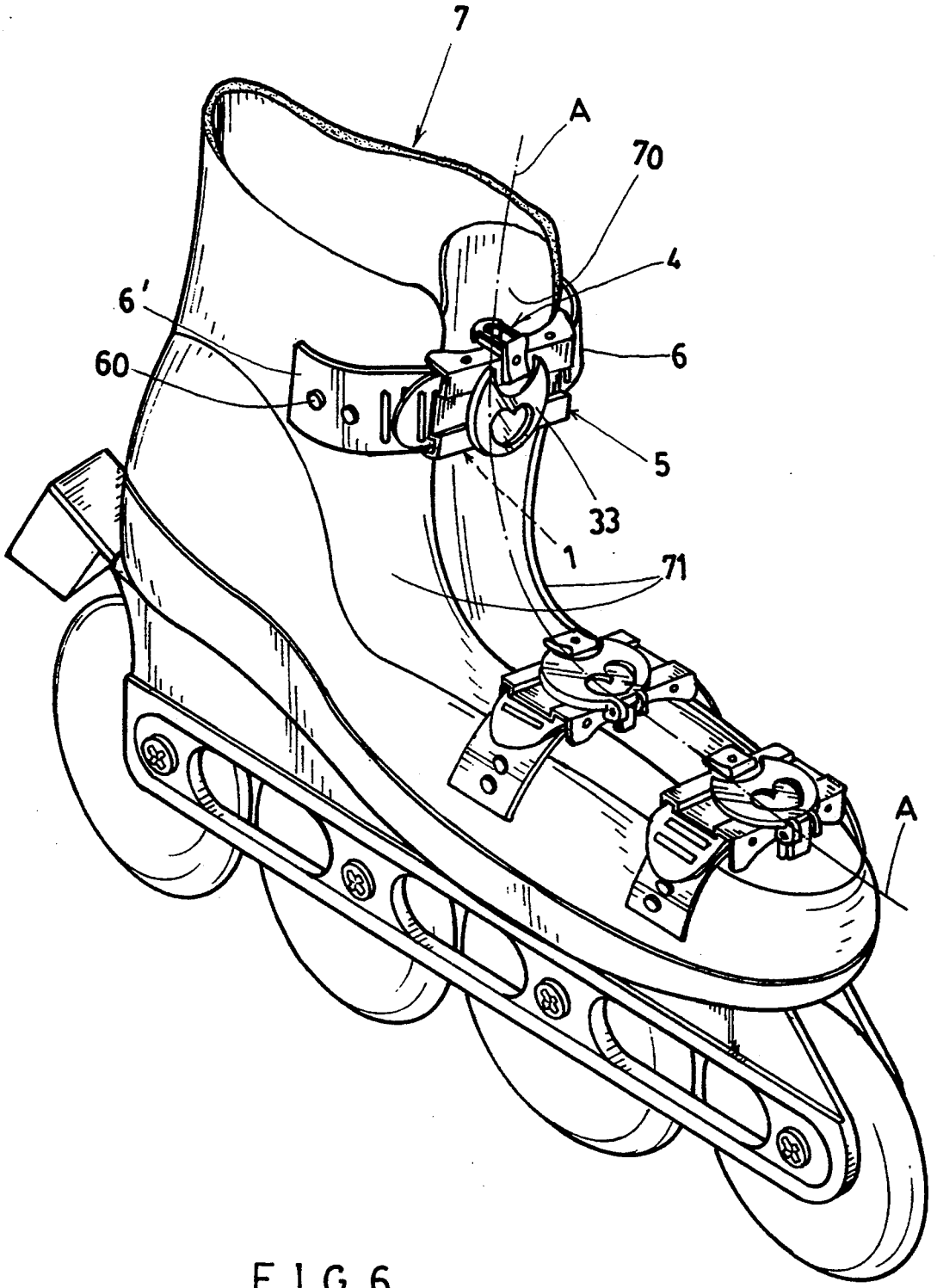
FIG. 6 shows an application of plural buckle means of the present invention when mounted on a boot of roller skate.

As shown in FIGS. 1–6, the present invention comprises: a buckle body 1, a reel 2 pivotally secured in the buckle body 1 around a longitudinal axis 10*a* projectively aligned with a center line A longitudinally disposed in a center portion of a shoe tongue 70 of a shoe or boot 7 of a roller skate as shown in FIG. 6 or other sporting shoes, not limited in this invention, a fastening means 3 and a releasing means 4 respectively disposed on a front end F and a rear or back end B of the buckle body 1, two straps 6, 6' respectively secured to two upper side portions 71 of a shoe upper of the shoe or boot 7, and an upper cover 5 shielding the buckle body 1 having two straps 6, 6' centralized in the buckle body 1.

The buckle body 1 includes: a strap holder 11 having an upper platform 12 formed on an upper surface of the strap holder 11 for slidably laying thereon a first strap 6 secured to a first upper side or left side portion of the shoe upper of the shoe 7, a lower slot 131 notched in a lower plate portion 13 of the strap holder 11 for slidably passing therein a second strap 6' secured to a second upper side or right side portion of the shoe upper, two side arcuate bottom extensions 161 protruding downwardly from a bottom plate 16 below the lower plate portion 13 of the strap holder 11 to be firmly rested on the two upper side portions 71 of the shoe 7, a central arcuate bottom extension 161*a* protruding downwardly from the bottom plate 16 from the lower plate portion 13 to be firmly rested on a tongue portion 70 of the shoe 7, a central slot 121 longitudinally notched in a central portion of the upper platform 12 for receiving the reel 2 therein, a first socket 14 formed on a first or front end portion of the central slot 121, and a second socket 15 formed on a second or rear end portion of the central slot 121 for pivotally holding the reel 2 between the two sockets 14, 15.

The reel 2 includes an axle 20 having a central hole 23 longitudinally formed therein to be fixedly engaged with a spindle 10 rotatably mounted in the two sockets 14, 15 about a longitudinal axis 10*a*, a pair of round wheels 21 respectively formed on both a first (or front) end and a second (or rear) end of the axle 20 and rotatably held in two recesses 17, 17' recessed in the two sockets 14, 15, and a plurality of keys 22 longitudinally juxtapositionally formed on the axle 20 each key 22 radially protruded from the axle 20 about the longitudinal axis 10*a* and each key 22 engageable with each corresponding longitudinal slit 62 transversely slotted in each strap 6 or 6', whereby upon a winding of the reel 2, the straps 6, 6' can be inwardly fastened as driven by the plurality of keys 22 of the reel 2 when operatively actuated or driven by a fastening means 3.

Figure 3:
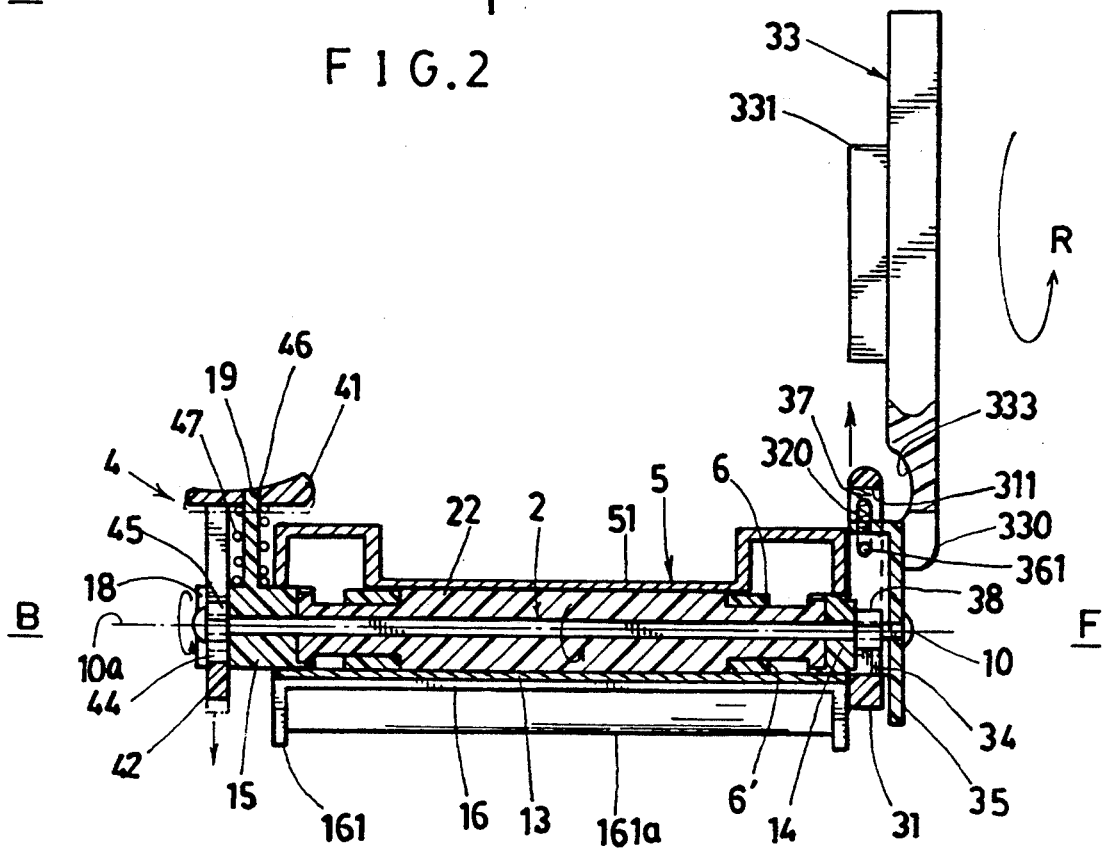
FIG. 3 is a sectional drawing of the present invention for forwardly biasing the fastening means for fastening the straps.

The fastening means 3 includes: a first ratchet gear 38 secured on an outer portion of the spindle 10 opposite to a second ratchet gear 45 of a releasing means 4 formed on an inner portion of the spindle 10, a driving coupler 31 having a first pawl 34 formed on a lower portion of the coupler 31 and engaged with the first ratchet gear 38 for driving the first ratchet gear 38 in a single direction such as a forward rightward rotation R as shown in FIG. 3 for rotating the reel 2 for fastening the two straps 6, 6', a biasing lever 35 pivotally mounted on an outermost end portion of the spindle 10 resiliently coupled with the driving coupler 31, and a driving disk 33 pivotally secured to the biasing lever 35 for operatively biasing the biasing lever 35 rightwardly R as shown in FIG. 3 for driving the pawl 34 to rotate the first ratchet gear 38 to rotate the reel 2 for fastening the two straps 6, 6' for wearing the shoe on a wearer's foot. The gear 38 is rotatably rested on an extension 141 protruding frontwardly from the first socket 14.

The biasing lever 35 includes: a spindle hole 351 longitudinally formed through the lever 35 for rotatably mounting the lever 35 on the spindle 10 about the axis 10*a*, a pin hole 360 transversely formed through an inner extension 36 protruding inwardly or rearwardly from an outer plate 39 for inserting a pin 361 into the pin hole 360 for pivotally securing the driving disk 33 to the biasing lever 35, and a tensioning spring 37 retained in a spring socket 350 recessed in an upper portion of the biasing lever 35 resiliently urging the driving coupler 31 upwardly for coupling the driving coupler 31 with the first gear 38, when the driving disk 33 is raised upwardly as shown in FIG. 3.

The driving coupler 31 includes: a pawl 34 formed in a lower portion of an arch member 32 having a pair of inner side walls 310 slidably engageable with an outer extension 141 of a first socket 14 rotatably holding a front end of the axle 2, and the inner extension 36 of the biasing lever 35, a pair of side slots 320 formed in the arch member 32 for slidably passing the pin 361 therethrough, and an upper bar portion 312 transversely formed on an upper portion of the arch member 32 having a bottom bar portion 311 resiliently urged upwardly by the tensioning spring 37 on the biasing lever 35 for engaging the pawl 34 with the first ratchet gear 38 for driving the pawl 34 to rotate the gear 38 and reel 2 for fastening two straps 6, 6' when rightwardly (R) biasing the lever 35. The upper bar portion 312 of the driving coupler 31 is depressed (D) downwardly by an arcuate recess 333 in the driving disk 33 when pivotally closed downwardly from FIG. 3 to FIG. 5 to engage a bottom or inner extension 331 of the driving disk 33 with a protrusion 54 of an upper cover 5 for locking the driving disk 33, thereby lowering and uncoupling the pawl 34 from the ratchet gear 38 as shown in FIG. 5.

The driving disk 33 includes: a pair of lugs 330 pivotally secured to the biasing lever 35, an inner or bottom extension 331 engageable with a protrusion 54 of an upper cover 5 for closing the disk 33 on the upper cover 5 after finishing the rotation movement of the first gear 38 and reel 2 (FIG. 5), and an arcuate notch 332 cut in the disk 33 adapted for an easy access of a wearer's finger for raising the disk 33 upwardly as shown in FIG. 3.

The releasing means 4 includes: a second pawl 44 formed in a lower portion of a bottom block 43 secured to a lower portion of a hollow column 42 having two opposite side wall portions 420 slidably engageable with a recess 18 notched in a second socket 15 rotatably holding a rear portion of the reel 2, a depression plate 41 perpendicularly secured to the hollow column 42 having a stem hole 46 formed in the depression plate 41 for engaging a stem 19 protruding upwardly from the second socket 15 and normally tensioned upwardly by a tensioning spring 47 disposed around the stem 19 for urging the hollow column 42 and the second pawl 44 upwardly for engaging a second ratchet gear 45 secured to a rear or second end portion of the spindle 10, the bottom block 43 being upwardly retained on a bottom portion of the second socket 15 when the depression plate 41 is upwardly urged by the spring 47, the ratchet gear 45 being rotatable in a single direction as Same as a rotating direction (such as a rightward rotation R as shown in FIG. 3) of the first ratchet gear 38 when rotating the reel 2 for fastening the two straps 6, 6' so that when the biasing operation for rotating the biasing lever 35 and the reel 2 is stopped, a reverse rotation of the second ratchet gear 45 in opposite to the forward (rightward) rotation R for fastening the two straps 6, 6' will be braked by the second pawl 44 to prevent any unexpected automatic reverse rotation of the reel 2 when forwardly rotated for tightly fastening the straps 6, 6' for wearing the shoe 7, whereby upon a downward depression D' of the depression plate 41 to lower the hollow column 42 to disengage the second pawl 44 from the second ratchet gear 45, the second ratchet gear 45 is released to loosen the two straps 6, 6' from their fastened or tightened state for removing the shoe 7 from a wearer's foot. When the depression plate 41 is downwardly depressed D' to release the pawl 44 from the second ratchet gear 45, the disk 37 is also closed D to lower the first pawl 34 from the first ratchet gear 38 to uncouple the first gear 38 from the first pawl 34, allowing a free rotation of the spindle 10 and reel 2 for their unwinding and loosening of the straps 6, 6'.

The upper cover 5 includes: an upper recess 51 concavely recessed from two end walls 52 of the cover, having a pair of protrusions 54 formed on both front and rear end portions of the cover 5, each end wall 52 having a central notch 53 cut in a lower portion of the end wall 52 for engaging either the first socket 14 or the second socket 15 and each end wall 52 secured on the strap holder 11 by pins 54*a*.

The two straps 6, 6' are respectively secured to two upper side portions 71 of a shoe upper by riveting each revet hole 61 formed in the strap with a rivet 60 formed on each upper side portion of the shoe upper. Other ways for fixing the strap on the shoe upper may be modified by those skilled in the art.

Figure 1:
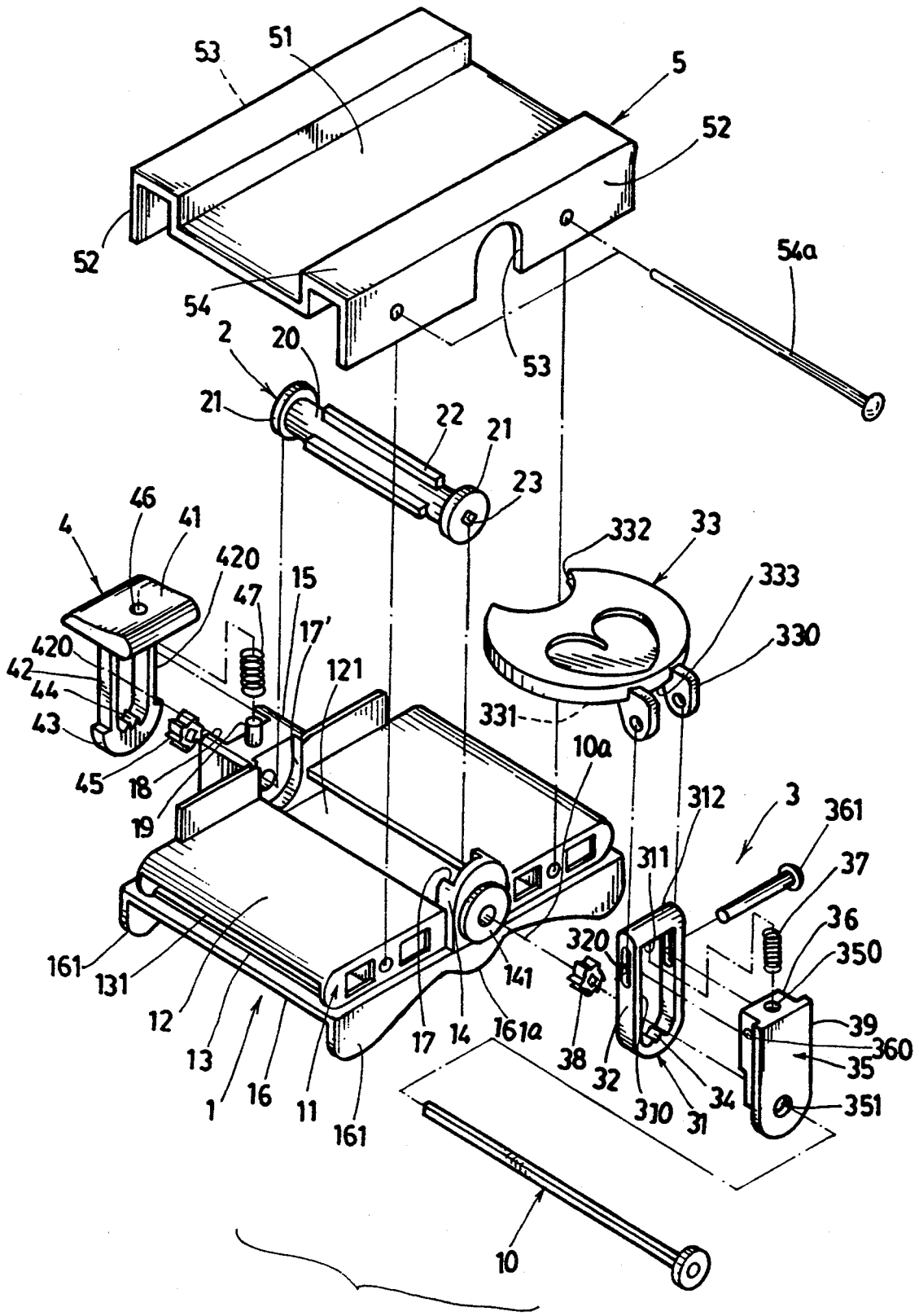
FIG. 1 is an exploded view of the present invention.
Figure 2:
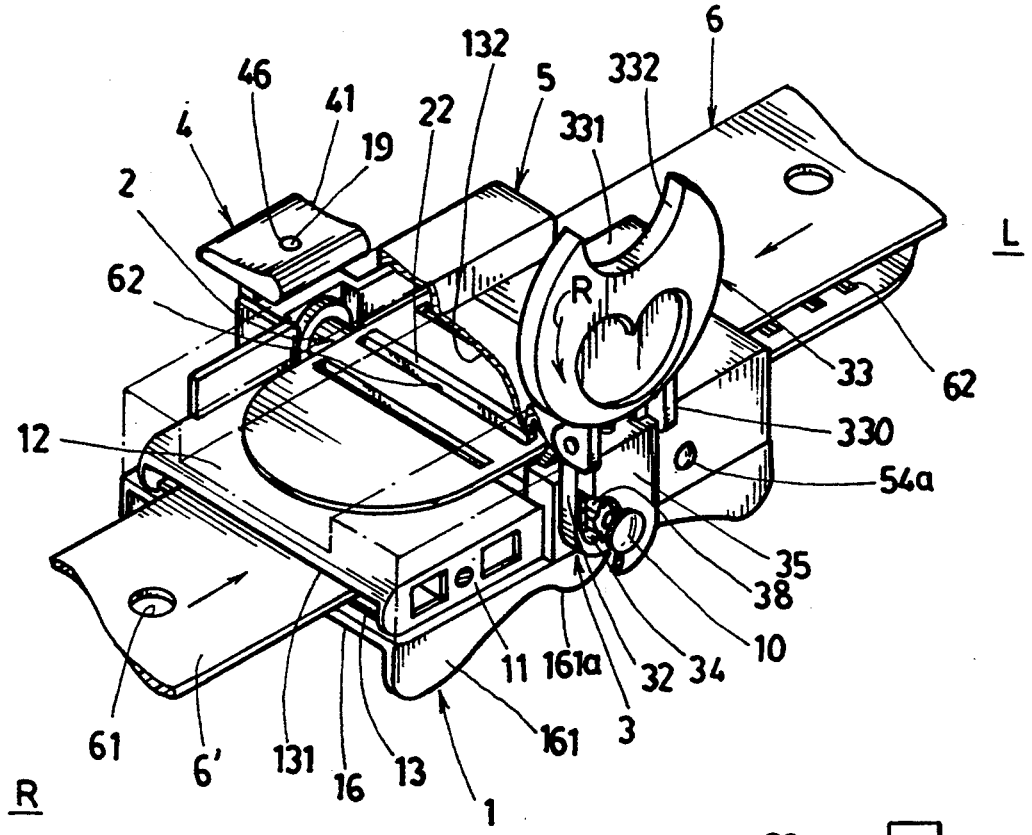
FIG. 2 is a partial cut-away illustration of the present invention.

As shown in FIGS. 3, 4, a rightward biasing movement of the lever 35 will allow the first pawl 34 to rightwardly drive the first ratchet gear 38 for rotating the reel 2 for fastening the two straps 6, 6' for wearing purpose. A rightward rotation R of the reel 2 will allow an upper key 22 to drive the first strap 6 towards the right side (R) on the platform 12 and will allow a lower key 22 to drive the second strap 6' towards the left side (L) through the slot 131 as shown in FIG. 2 for tightly fastening the two straps 6, 6'.

Therefore, the present invention has the advantages of: quicker and convenient fastening of a shoe, easier and adjustable control for the tightness when fastening the shoe, a centralized positioning of the buckle means to minimize the chances to be attacked and damaged, and more ergonomic and comfortable fastening and wearing of a shoe.

The present invention may be utilized for shoe or boots of roller skate, sporting shoes or any other footwears, not limited in this invention.

The spindle 10 is preferably made, but not limited, as a square rod engageable with a square hole formed in each ratchet gear 38, 45, and the reel 2 for firmly securing the spindle 10 with the relevant elements.

Other modifications for the elements, construction and arrangements of the present invention may be made without departing from the spirit and scope of this invention.

The rotation or driving directions as aforementioned may also be alternated or changed by modifying the relative orientations of the ratchet gears with their corresponding pawls, which are not limited in this invention.

I claim:

1. A shoe buckle comprising: a buckle body positioned on a central tongue of a shoe; two straps respectively secured to two upper side portions of a shoe upper and protruding inwardly to the buckle body of the shoe; a reel pivotally secured in the buckle body for fastening the two straps; a fastening means provided on a front end portion of said buckle body for driving the reel for fastening the straps for wearing the shoe on a wearer's foot; and a releasing means provided on a rear end portion of said buckle body for releasing the two straps for removing the shoe, thereby enabling a stable and convenient fastening of a shoe;

said buckle body including: a strap holder having an upper platform formed on an upper surface of the strap holder for slidably laying thereon a first strap secured to a left side portion of the shoe upper of the shoe, a lower slot notched in a lower plate portion in the strap holder for slidably passing therein a second strap secured to a right side portion of the shoe upper, two side arcuate bottom extensions protruding downwardly from a bottom plate below the lower plate portion of the strap holder to be firmly rested on the two upper side portions of the shoe, a central arcuate bottom extension protruding downwardly from the bottom plate below the lower plate portion to be firmly rested on a tongue portion of the shoe, a central slot longitudinally notched in a central portion of the upper platform for receiving the reel therein, a first socket formed on a front end portion of the central slot, and a second socket formed on a rear end portion of the central slot for pivotally holding the reel between the two sockets; and said reel including: an axle having a central hole longitudinally formed therein to be fixedly engaged with a spindle rotatably mounted in the two sockets about a longitudinal axis, a pair of round wheels respectively formed on both a front end and a rear end of the axle and rotatably held in two recesses recessed in the two sockets, and a plurality of keys longitudinally juxtapositionally formed on the axle each said key radially protruded from the axle about the longitudinal axis and each said key engageable with each corresponding longitudinal slit transversely slotted in each said strap, whereby upon a winding of the reel, the straps can be inwardly fastened as driven by the plurality of keys of the reel when operatively driven by a fastening means.

2. A shoe buckle according to claim 1, wherein said fastening means includes: a first ratchet gear secured on an outer portion of the spindle opposite to a second ratchet gear of said releasing means formed on an inner portion of the spindle, a driving coupler having a first pawl formed on a lower portion of the coupler and engaged with the first ratchet gear for driving the first ratchet gear in a single direction of a forward rightward rotation for rotating the reel for fastening the two straps, a biasing lever pivotally mounted on an outermost end portion of the spindle and coupled with the driving coupler, and a driving disk pivotally secured to the biasing lever for operatively biasing the biasing lever rightwardly for driving the pawl to rotate the first ratchet gear to rotate the reel for fastening the two straps for wearing the shoe on a wearer's foot.

3. A shoe buckle according to claim 2, wherein said biasing lever includes: a spindle hole longitudinally formed through the lever for rotatably mounting the lever on the spindle about the axis, a pin hole transversely formed through an inner extension protruding inwardly from an outer plate, a pin inserted into the pin hole for pivotally securing the driving disk to the biasing lever, and a tensioning spring retained in a spring socket recessed in an upper portion of the biasing lever resiliently urging the driving coupler upwardly for coupling the driving coupler with said first ratchet gear, when the driving disk is raised upwardly.

4. A shoe buckle according to claim 3, wherein said driving coupler includes: a pawl formed in a lower portion of an arch member having a pair of inner side walls slidably engageable with an outer extension of a first socket rotatably holding a front end of the axle, and the inner extension of the biasing lever, a pair of side slots formed in the arch member for slidably passing the pin therethrough, and an upper bar portion transversely formed on an upper portion of the arch member having a bottom bar portion resiliently urged upwardly by the tensioning spring on the biasing lever for engaging the first pawl with the first ratchet gear for driving the pawl to rotate the first gear and said reel for fastening said two straps when rightwardly biasing the lever.

5. A shoe buckle according to claim 1, wherein said releasing means includes: a second pawl formed in a lower portion of a bottom block secured to a lower portion of a hollow column having two opposite side wall portions slidably engageable with a recess notched in a second socket rotatably holding a rear portion of the reel, a depression plate perpendicularly secured to the hollow column having a stem hole formed in said depression plate for engaging a stem protruding upwardly from the second socket and normally tensioned upwardly by a tensioning spring disposed around the stem for urging the hollow column and the second pawl upwardly for engaging a second ratchet gear secured to a rear end portion of the spindle, the bottom block being upwardly retained on a bottom portion of the second socket when the depression plate is upwardly urged by the spring, whereby upon a downward depression of the depression plate to lower the hollow column to disengage the second pawl from the second ratchet gear, the second ratchet gear is released to loosen the two straps from their fastened or tightened state for removing the shoe from a wearer's foot.

* * * * *